United States Patent [19]

Minnetti

[11] 4,391,360

[45] Jul. 5, 1983

[54] MACHINE FOR HANK DRAWING AND DOFFING

[75] Inventor: Federico Minnetti, Pieve A Nievole, Italy

[73] Assignee: Officine Minnetti Di Ornella Raveggi & C.S.a.s., Pieve A Nievole, Italy

[21] Appl. No.: 187,638

[22] Filed: Sep. 16, 1980

[30] Foreign Application Priority Data

Mar. 14, 1980 [IT] Italy ..... 20669 A/80

[51] Int. Cl.[3] ..... B65G 47/24

[52] U.S. Cl. ..... 198/412; 28/287; 198/486; 198/488; 242/53; 414/564; 414/590; 414/668; 414/908

[58] Field of Search ..... 414/911, 908, 564, 668, 414/590, 225, 226, 222, 735, 741; 198/486, 379, 477, 484, 488, 412, 678; 8/155.2; 242/53; 28/287, 288, 291; 68/210; 294/63 R, 87 R; 53/116, 430

[56] References Cited

U.S. PATENT DOCUMENTS

| | | | |
|---|---|---|---|
| 1,401,520 | 12/1921 | Clauss | 28/291 X |
| 2,927,679 | 3/1960 | Rively | 198/339 X |
| 3,480,220 | 11/1969 | Hanscom | 242/53 |
| 3,656,215 | 4/1972 | Tanno | 28/291 |
| 3,885,754 | 5/1975 | Delerue . | |
| 4,183,427 | 1/1980 | Tomikawa | 198/486 X |
| 4,274,792 | 6/1981 | Roth et al. | 198/486 X |
| 4,281,959 | 8/1981 | Minnetti | 414/668 |
| 4,336,875 | 6/1982 | Minnetti | 198/486 |

FOREIGN PATENT DOCUMENTS

| | | |
|---|---|---|
| 23770 | 4/1906 | Australia . |
| 54160 | 6/1912 | Australia . |
| 135123 | 5/1901 | Fed. Rep. of Germany . |
| 135124 | 6/1901 | Fed. Rep. of Germany . |
| 56738 | 12/1911 | Switzerland . |
| 112596 | 11/1925 | Switzerland . |
| 180341 | 8/1923 | United Kingdom . |
| 1018580 | 1/1966 | United Kingdom . |
| 1277513 | 6/1972 | United Kingdom . |
| 1400021 | 7/1975 | United Kingdom . |

*Primary Examiner*—Bruce H. Stoner, Jr.
*Attorney, Agent, or Firm*—Fleit, Jacobson & Cohn

[57] ABSTRACT

The invention is concerned with a machine for drawing yarn hanks from advancing hank carrying supports and doffing the drawn hanks on a carriage or container or conveyor belt. The machine comprises a pliers holder head wherein the pliers, each formed of two or more rods movable near one another, can be adjusted in spacing for adaptation to various dimensions of hanks. The head is rotatable about a horizontal axis to arrange the hanks in horizontal direction and is tiltable or upsettable about a further horizontal axis. Furthermore, the head is mounted to be movable parallel to the extension of the hank carrying supports, and preferably also parallel to the advancement or feeding of the hank carrying supports.

31 Claims, 18 Drawing Figures

FIG.4
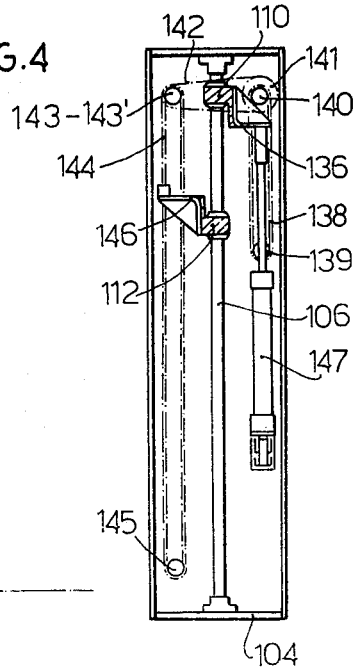
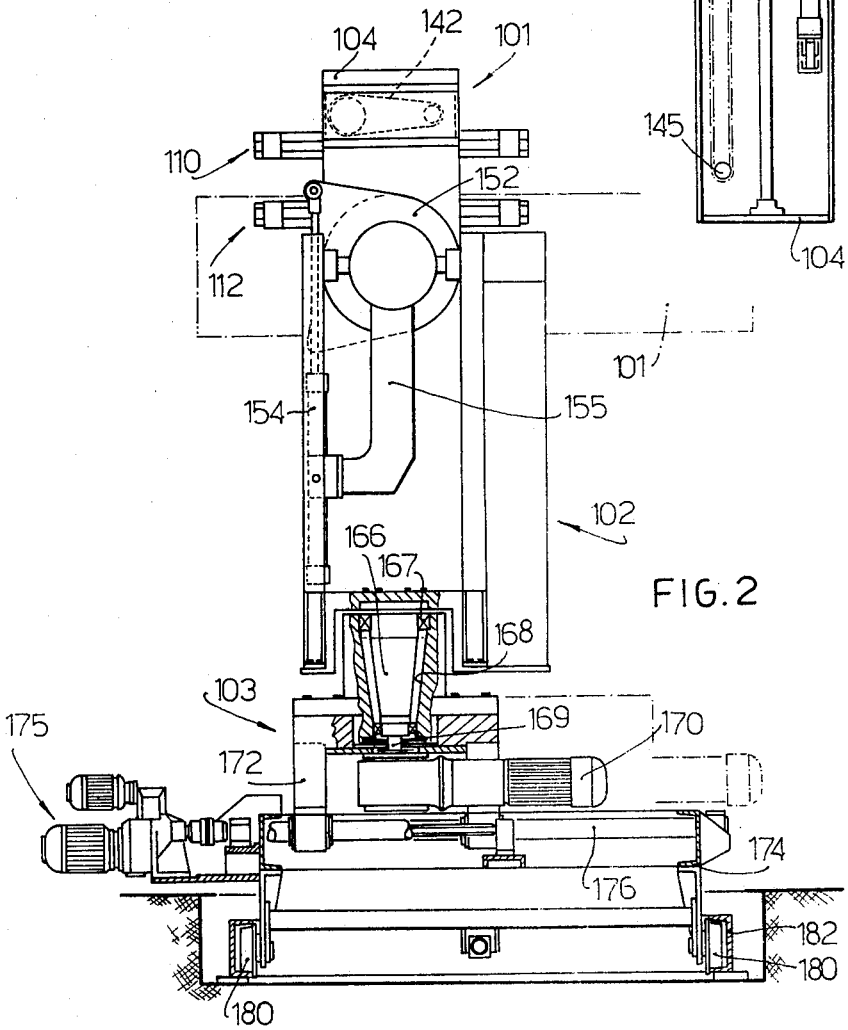
FIG. 2

FIG.5
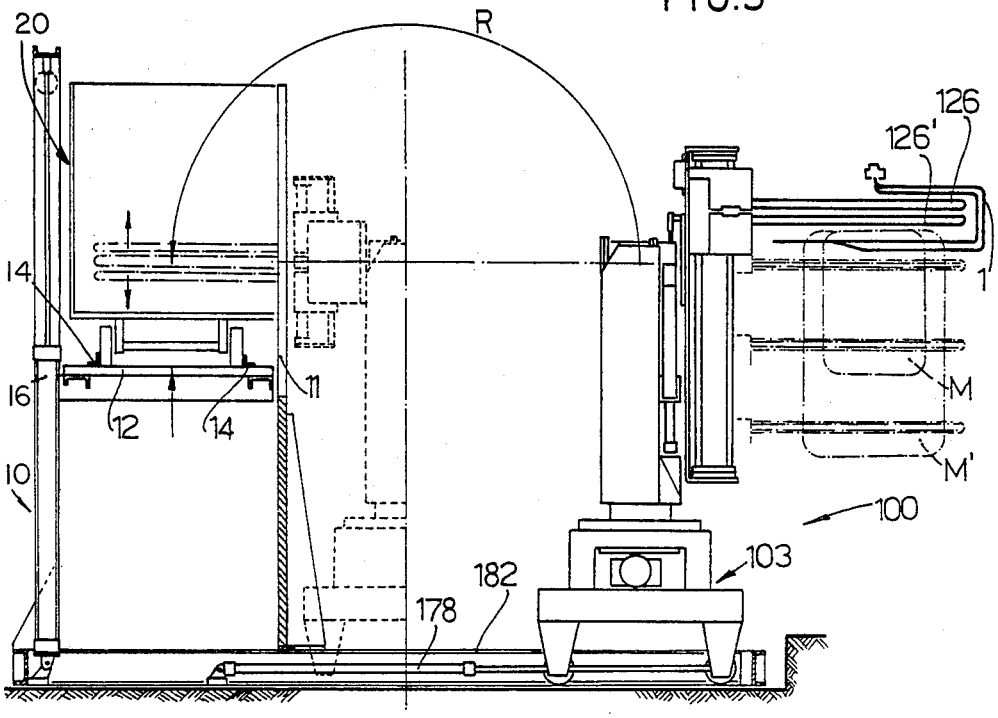
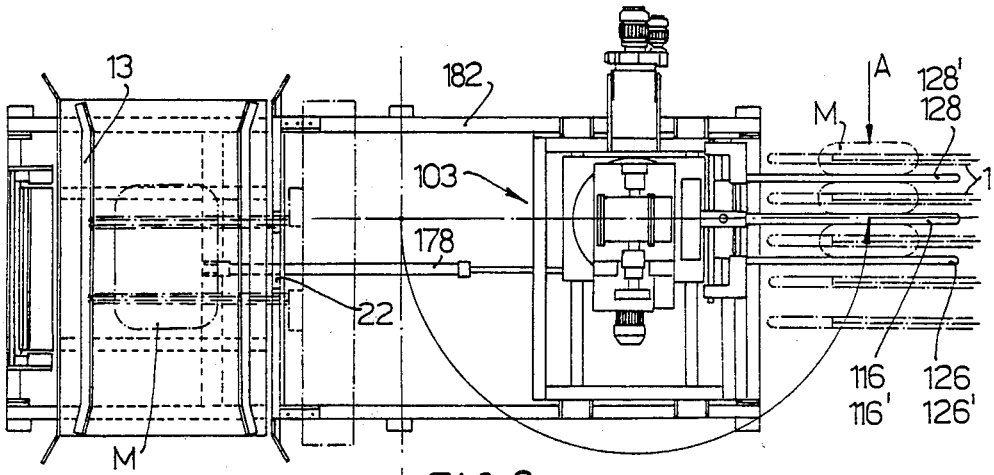
FIG.6

FIG. 13
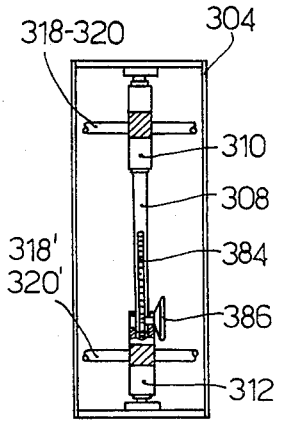
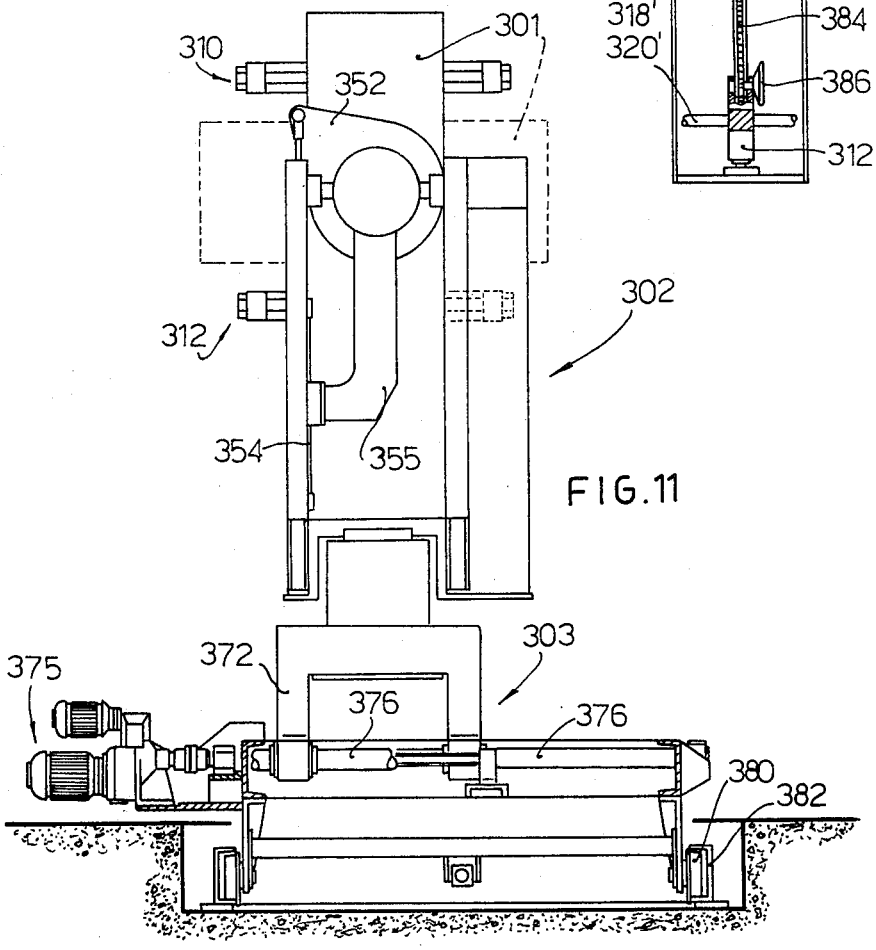
FIG. 11

MACHINE FOR HANK DRAWING AND DOFFING

This application relates to the field of hank yarn treating systems or plants.

In such plants, the yarn hanks, for example outcoming from a drier, are carried as threaded on hank carrying supports, the latter being integral with a chain moving along a rail means. Each of the hank carrying supports comprises a substantially horizontal suporting arm transversely of the chain and an attachment arm to the chain. At one or more locations of the plant, the need may arise of drawing the hanks, or some of the hanks, from the respective hank carrying supports for placing the same on another transporting or packaging means, such as on a carriage in case carrying then the hanks to another station.

At present the operations for gripping the hanks and placing such hanks on a carriage are manually carried out; that is, there are workmen removing the hanks, downward vertically depending from the hank holders, and arranging them on one another in horizontal attitude on a carriage. Of course, due to the use of labour, the operation is expensive and troublesome. Therefore, the object was followed to develop a machine providing for automatically drawing the hanks from the hank carrying supports as the latter are fed by continuous or trigger motion, and orderly arranging such hanks in a container or carriage. A machine according to the present invention attains the above outlined objects.

A machine according to the present invention substantially comprises a rod holder or pliers holder head for gripping one or more hanks; the head carries means for gripping the hanks at a plurality of locations in the longitudinal direction thereof; preferably such means comprise at least two pliers, or sets of rods, which may be placed at some distance from one another lengthwise of a depending hank, each of the pliers comprise at least two rods, or preferably three (or more) rods that can be moved near one another for respectively gripping one or two (or more) hanks. Generally, the center rod in each pliers is fixed or stationary and the side rods are movable. The head is mounted on members movable parallel to the extension of the supporting arm for the hank carrying supports, in order to unthread or remove the hanks therefrom, and rotates through about 90° about a substantially horizontal axis parallel to the supporting arms, so as to carry the retained hank from a substantially vertical attitude to a substantially horizontal attitude. The pliers holder head is also tiltable or upsettable about a horizontal axis perpendicular to the first mentioned axis of rotation through about 180°, so as to carry the supported hank from a position adjacent the conveyor to a position on a carriage or packaging box, with which the machine cooperates. Preferably, the machine is mounted for a movement parallel to the advancement or feeding of said hank carrying supports.

In one embodiment, the pliers holder head is also capable of rotating through 180° about a vertical axis.

The spacing between the two pliers of the head can be adjusted, for example by manual operation; in one embodiment, the pliers are at fixed spacing from each other during the entire working cycle, and the rods are inserted between the hanks at the front side; in another embodiment, in the working cycle the pliers are moved near and away from each other, for sidewise insertion thereof in the hank carrying supports and then from top to bottom along the hanks.

A machine according to the invention is designed to cooperate with a carriage or container on a lifting device adjustable in height. However, a particular variant of the machine can cooperate with a carriage or container fixed in height, and in such a variant the pliers holder head is mounted adjustable in height.

Some embodiments of the invention will now be described with reference to the accompanying drawings, in which:

FIG. 2 is a view as seen from the left in FIG. 1, with some parts being removed in order to show the underlying parts;

FIG. 4 is a sectional view taken along line 4—4 of FIG. 1;

FIGS. 5 and 6 are side and plan views respectively, on a different scale from that of FIGS. 1 to 4, showing various operating positions for the machine shown in FIGS. 1 to 4;

FIG. 11 is a view as seen from the left in FIG. 10;

FIG. 13 is a sectional view taken along line 13—13 of FIG. 10;

Figure 1:
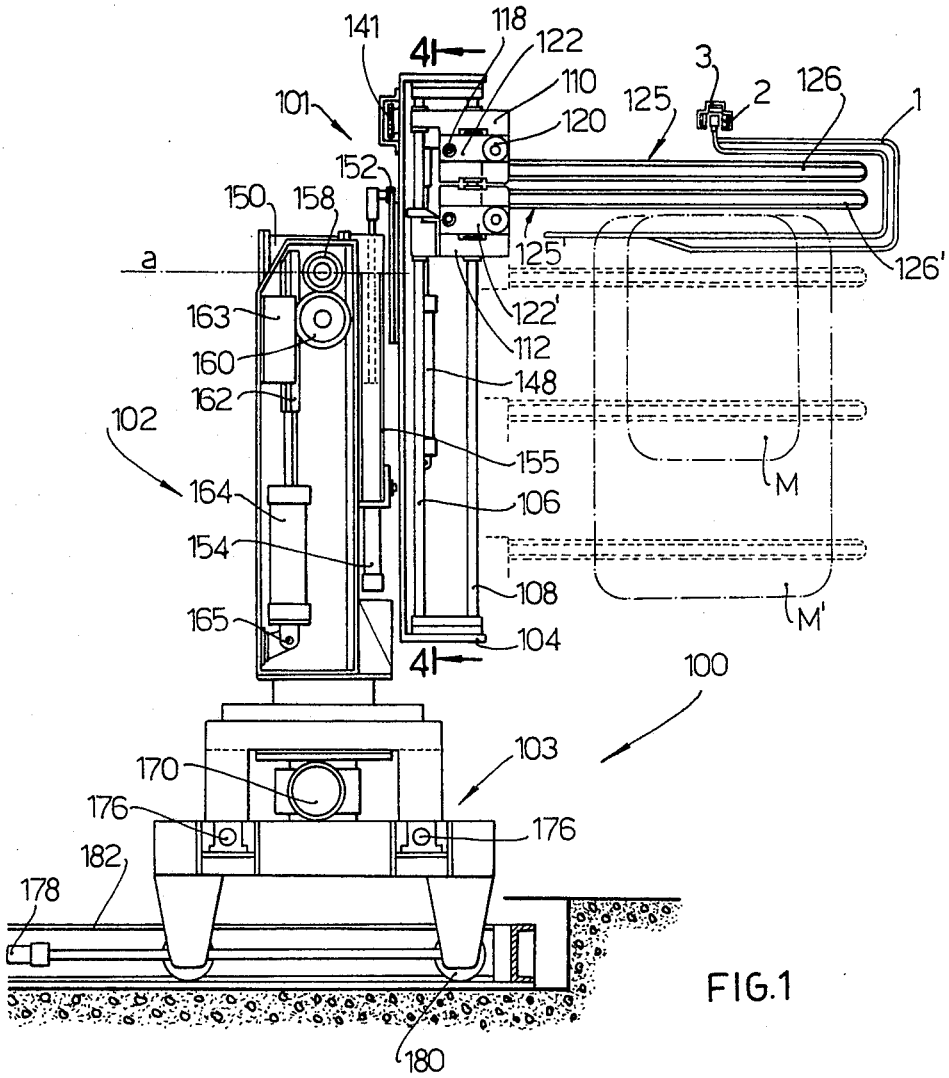
FIG. 1 is a side view with parts being removed, showing a first embodiment of the machine for hank drawing and doffing, wherein the pliers; or hank gripping rods, are shown by full or continuous line at a position drawn near one another and by broken line at a plurality of positions moved away from one another.

As shown in FIGS. 1 to 4, a machine according to the invention cooperates with a hank movement line, of which a hank carrying support 1 is shown by dashed line, at the top connected to a conveyor chain 2 movable within a rail 3. The hank carrying support and associated chain and rail are of conventional construction, except for the particular configuration of the support as seen from the top, that is said support has a particularly wide space between its base or horizontal arm and its arm for attachment to the chain, and this for a purpose which will become apparent in the following. The support carries one or more dependent hanks which can be equal to one another or may on the other hand be of various dimensions; by way of illustration, there has been shown on the drawings a hank M' of a greater size and a hank M of less size (shown by dashed lines).

The machine 100 shown in FIGS. 1, 2, 3 and 4 comprises a pliers holder or rod holder head, shown as a whole at 101, which is carried on a framework, shown as a whole at 102, which in turn is carried on a movable base 103.

Figure 3:
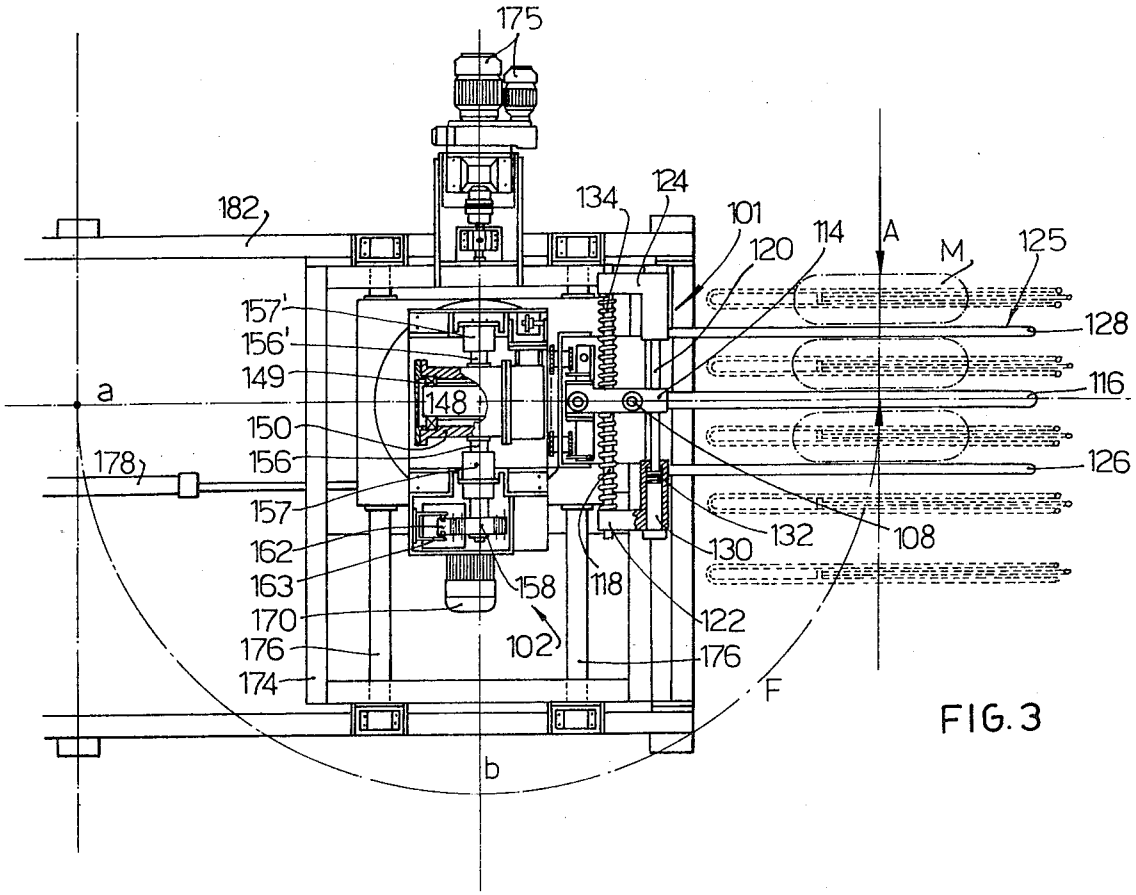
FIG. 3 is a top view of FIG. 1 with parts being removed.

Said rod holder head 101 comprises a rigid frame 104 carrying two slide guides or parallel vertical columns 106 and 108. Two sliding shoes are mounted on said two columns 106 and 108, of which the upper shoe is designated at 110, while the lower shoe is designated at 112; both of these shoes are movable along the columns. Each of the shoes (in the following only the upper shoe which is shown in FIG. 3 will be described; the lower shoe is identical and the same elements thereof will be indicated by the same reference numerals followed by a prime) comprises a center portion 114 which remains stationary with respect to a direction transversely of the columns and carries a center rod 116, cantilever extended from the machine; said center portion 114 has two bars 118 and 120 (118', 120') integral therewith and transverse to the columns, while slides 122, 124 are slidably mounted on said bars 118, 120, each of slides carrying a movable hank gripping rod 126, 128, respectively. Rods 126, 116, 128 make up an upper pliers 125; whereas rods 126', 116', 128' make up a lower pliers 125'. The movable rods 126, 128 may be approached to the center rod to grip the hanks M (or M') or moved away to release the hanks. Generally, the clamping movement for the rods is controlled by fluid introduced into a cylinder chamber, such as 130, formed in slides 122 and 124, so as to drive piston 132 integrally formed with bar 120; while the release movement is preferably caused by springs 134.

The rod holder head 101 also comprises a control system for lifting and lowering with predetermined spaces for the upper and lower rod carrying sliding shoes 110 and 112, respectively. Such a system will now be described particularly referring to FIG. 4. A bracket 136 is integral with shoe 110 and is joined to a chain 138; the latter winds up between a wheel 139 and a further wheel 140, integral with a wheel of larger diameter, that is an expansible pulley variator 141. The pulley variator 141 has a set of pulleys of different diameters mounted on a common shaft so as to provide a variable ratio drive. A second chain 142 winds up between said variator 141 and a further gear wheel 143. And a further chain 144 extends between a gear wheel 143' integral with said gear wheel 143 and a further or last wheel 145. This last mentioned chain is connected to a bracket 146 of slide 112. When a cylinder-piston unit 147, which is secured at one end to frame 104, acts upon said bracket 136, the above described multiplying system will cause said bracket 146 to travel a predetermined path, equal to a multiple of that travelled by bracket 136.

The above described rod holder head is integral with a gudgeon pin 148, supported by bearings 149 in a sleeve 150 (FIG. 3). Said gudgeon pin has a flange 152 (FIG. 2) integral therewith, and a protrusion which is connected to the stem of a rotational cylinder-piston unit 154, carried by an arm 155. Upon the movement of said cylinder-piston unit 154, the above mentioned flange and gudgeon pin 148 rotate through about 90° within the sleeve about the axis "a" from the position shown by full line to the position shown by dashed line in FIG. 2. Of course, the whole rod holder head 101 rotates therewith through about 90° (position shown by dash-dotted line in FIG. 2), moving the rods and hank carried thereby from a vertically extended condition to a horizontally extended condition.

Sleeve 150 is integral with spindles 156, 156' with coincident axis substantially perpendicular to the axis of gudgeon pin 148 and carried on bearings 157, 157' fixed on said framework 102. A pinion 158 is mounted on spindle 156 and meshes with a gear wheel 160. The latter is driven by a rack 162 sliding within a fixed guide 163 and driven by a cylinder-piston unit 164, the latter being fixed at one end 165 to said framework 102. The movement of this cylinder-piston unit 164 causes said rod holder 101 to be tilted or upset about the axis "b" of said spindles 156, 156'.

The above mentioned framework 102 is carried on a pin 166, which is received to rotate about a vertical axis by bearings 167 within a seat 168 formed in said base 103. An extension 169 of the pin is rotatably driven about the vertical axis by conventional means (not shown) from a motor 170.

The movable base 103 comprises an upper frame 172, in which said seat 168 is formed, and a lower frame 174. The upper frame 172 is slidable through the action of a geared motor unit 175 on guides 176, the latter being parallel to the advancement or feeding of the hank carrying supports and carried on said lower frame 174. The latter is movable parallel to the extension of said hank carrying supports through the action of a cylinder-piston unit 178 (FIG. 1 and FIG. 3), and is carried by wheels 180 movable within rails 182.

For use with the machine for hank drawing and doffing or unloading according to the present invention, use is made of a carriage lifting device 10 shown in FIGS. 5 and 6. Therein, use is made of a conventional carriage, designated at 20, but devoid of a wall towards the machine. Said lifting device 10 comprises a supporting framework of any desired shape, wherein a wall 11 towards the machine has openings for the passage of the gripping rods 116, 126, 128 (116', 126', 128') of the machine. Within said framework, a movable platform 12, provided with rails 14 for the carriage wheels, is raised and lowered upon operation of a cylinder-piston unit 16.

The operation of this first embodiment of the machine will now be described with particular reference to FIGS. 5 and 6.

From a position, such as that shown in FIGS. 1 and 5, first there will be a pliers descent step, that is to say, the cylinder-piston unit 148 operates to lower the sliding shoes 110 and 112, then the relative rods 128, 116, 126, 128', 116', 126' laterally along the hanks hanging from the hank carrying supports. If the latter are continuously moving, at the same time the apparatus has imparted thereto a tracking movement parallel to the advancement or feeding (arrow A) of the hank holders along the guides 176, as caused by the geared motor 175. Then a rod closing step follows, wherein the side rods 128 and 128' at one side and 126 and 126' at the other side under control of the cylinder-piston units 130 and 132 move near the center rods 116, 116' for simultaneous clamping of two hanks M.

Upon completion of this hank clamping or gripping, there will occur a drawing transfer step, that is the apparatus moves along the guides 182 under the control of the cylinder-piston unit 178 to completely pull out the hanks M gripped by said hank carrying supports 1. Then, the tracking movement of the hank carrying supports may be stopped and the return movement (opposite to tracking) for the structure may be started.

Thus, the fourth step occurs, in which the head 101 is rotated through 90° under the operation of the cylinder-piston unit 154. Now the apparatus carries the hanks at horizontal attitude and moves on the guides 182, if required, to a position for doffing or unloading on carriage 20 (position shown by dashed line at the left of FIG. 5).

Then the tilting or upsetting cylinder-piston unit 164 is operated to tilt or upset said head through 180° (arrow R in FIG. 5) and thus the apparatus disposes said hanks M on a layer of hanks previously laid down with care on container means, such as said carriage 20. Then the pliers are opened, that is said rods 126, 126', 128, 128' move away from said rods 116, 116' for a sufficient space or distance to release the hanks. The cylinder-piston unit 178 then backward sufficiently moves the apparatus (to the right) in order to disengage the rods from said carriage 20 and lifting device 10. On said lifting device 10, an intermediate wall 22 may aid in holding the hanks on the carriage.

Then, the lifting device will rotate through 90° to dispose the rods in a vertical attitude and the upper and lower rods are moved near one another.

A backward or return rotation through 180° about a vertical axis (arrow F in FIG. 3), as caused by motor 170, carries the apparatus back to the conditions of FIG. 1. Obviously, some of the steps just described may be performed in a different order or simultaneously to one another.

The lifting device for said carriage 20 will be provided with means (not shown) for arranging such a carriage at a height or level suitable to receive the hanks.

Figure 7:
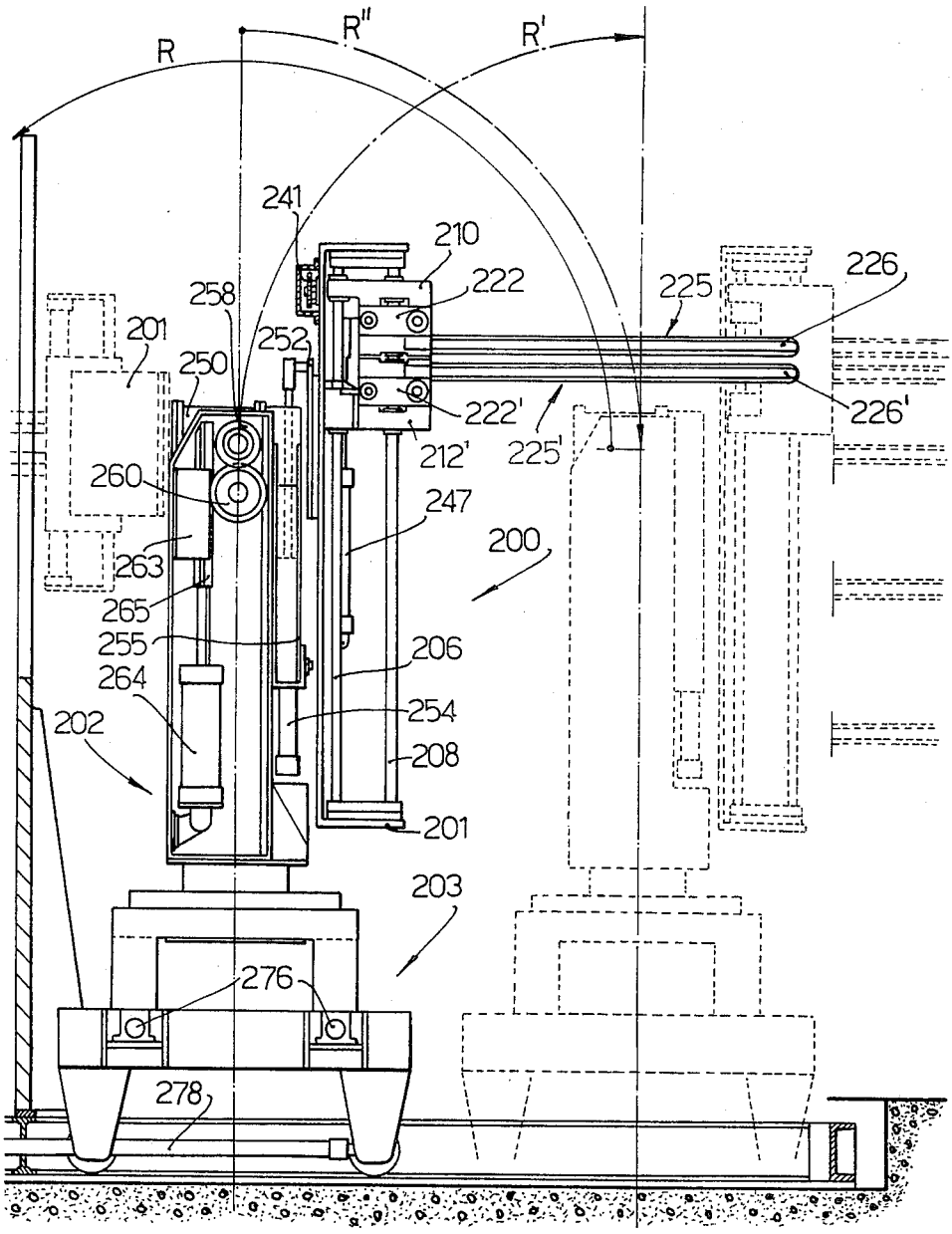
FIG. 7 is a side view, similar to that of FIG. 1, showing a second embodiment of a machine according to the invention.
Figure 8:
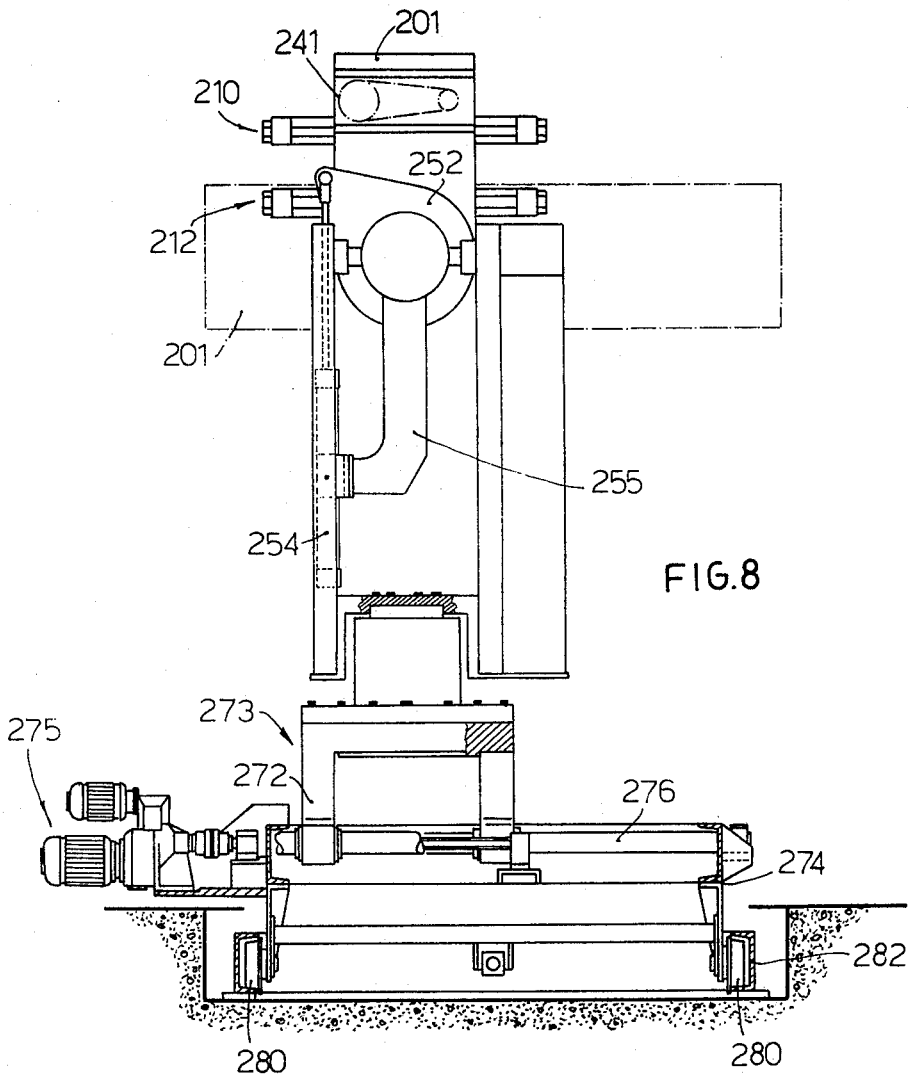
FIG. 8 is a view as seen from the left in FIG. 7.
Figure 9:
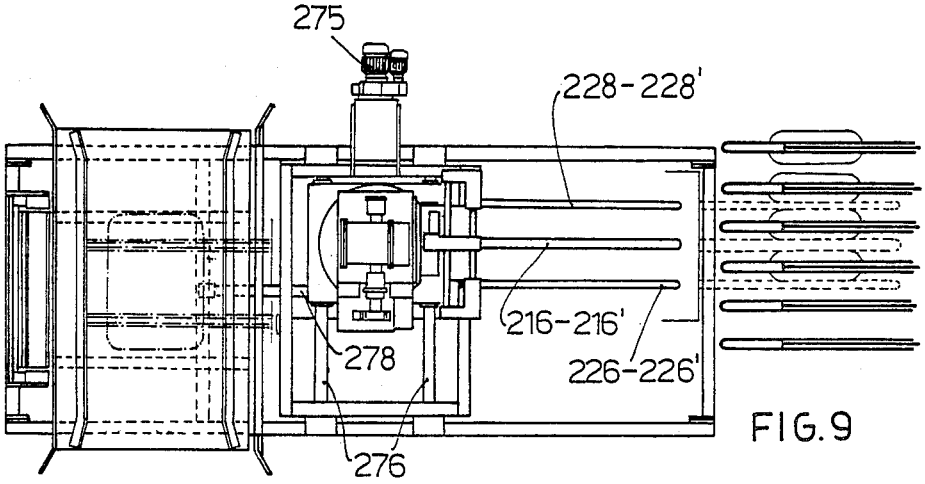
FIG. 9 is a schematic plan view, on a different scale from that of FIGS. 7 and 8, showing various operating positions for the machine shown in FIGS. 7 and 8.
Figure 12:
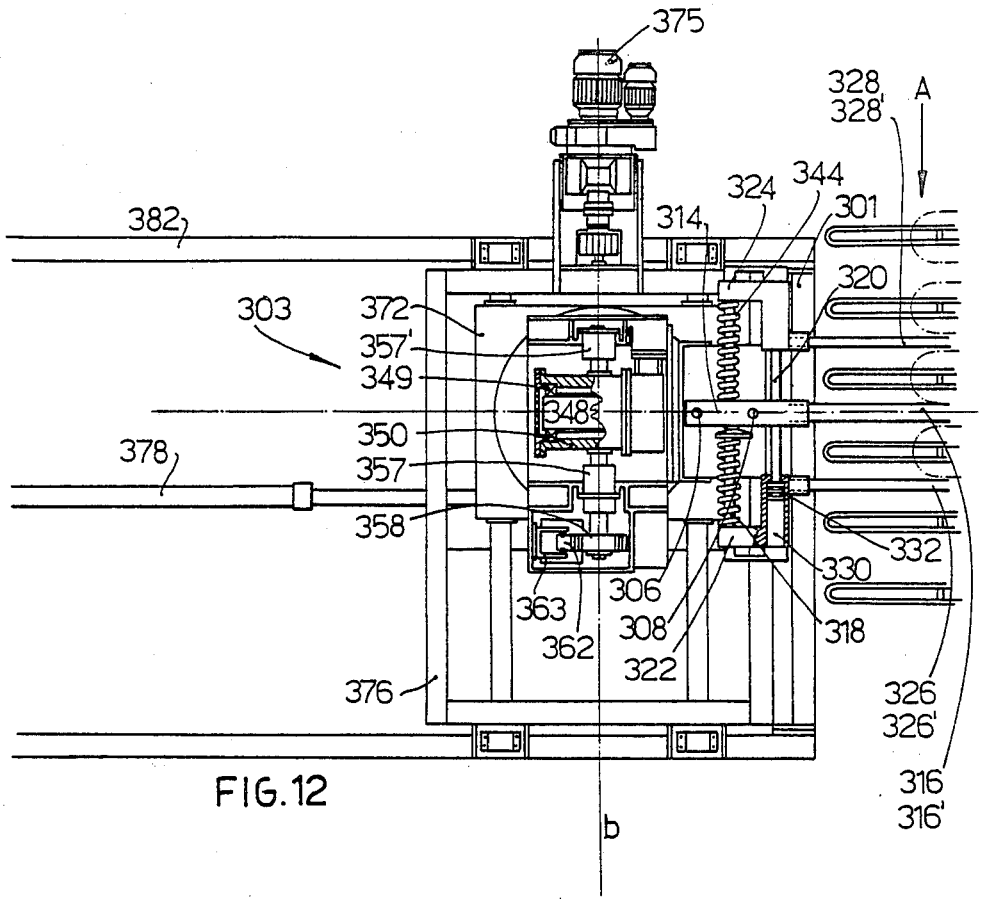
FIG. 12 is a top view of FIG. 10.

Referring to FIGS. 7 to 9, a second embodiment of a machine according to the invention will now be described. The machine of FIGS. 7 to 9 has been designated by reference numeral 200. Some parts of such a machine are identical to those of the above described machine 100 and have been designated by reference numerals like those for machine 100, but augmented by 100. In said figures of the drawings, it will be seen that the rod holder head 201 and associated elements exactly correspond to head 101 and associated elements; the head rotation device or mechanism 250, 252, 254, 255 is identical to the head rotation device or mechanism of the first embodiment; the tilting or upsetting device or mechanism 258, 260, 263, 264, 265 corresponds to the device or mechanism 158, 160, 163, 164, 165 for the above described first embodiment; the sliding system parallel to the advancement or feeding of the hank carrying supports comprises guides 276, corresponding to guides 176 (in this case the motor is not shown); and the movement system parallel to the extension of the hank carrying supports comprises guides 282, wheels 280 and cylinder-piston unit 278 similar to the elements 182, 180 and 178 shown in FIGS. 1 to 6. In the embodiments of FIGS. 7 to 9, the unit 166, 167, 168, 169 for rotation about a vertical axis is omitted, that is the framework 202 cannot rotate about a vertical axis, but is fixed on the base 203. The operation of machine 200 will now be described.

Starting from the initial position, shown by full line in FIG. 7, in which the set of upper rods 226, 216, 228 (or upper pliers 225), and the set of lower rods 226', 216', 228' (or lower pliers 225') for the pliers holder head 201 are vertically moved near one another, but with the three upper rods and the three lower rods spaced apart from one another, there first occurs a drawing transfer under the operation of the cylinder-piston unit 278 to the right of FIG. 7 to the position as shown by dashed line, in which the rods are threaded over the supporting arm for the hank carrying supports 1. At the same time, the structure has imparted thereto a tracking movement for the hank carrying supports or hooks, as caused by the geared motor 275. Then, the sets of rods downward move along the hanks (by operation of a mechanism of the type as that shown in FIG. 4 for the first embodiment), and the rods close on the hanks (as shown for the first embodiment). Then, the cylinder-piston unit 278 moves the structure away from the hank holders (to the left in the drawing again to the position shown by full line), thus unthreading the hanks. Now, the hook tracking movement is stopped and the return movement (opposite to tracking movement) is started for the structure.

Then, head 201 is rotated through 90° about a horizontal axis under the operation of the cylinder-piston unit 254; the head 201 is moved (FIG. 8) to the dash-dotted line position and the hanks move from the vertically holding position to the horizontally holding position. At the same time, if required, the structure moves along the guides 282 to adapted position for doffing or unloading on the carriage 20. Thus, the head 201 is upset or tilted through 180° (arrow R) about the horizontal axis of pinion 258 under the operation of wheel 260 controlled by the rack 265 from the cylinder-piston unit 264. This upsetting or tilting carries the hanks on carriage 20, the latter having been preset in height to receive such hanks. Then, a pliers opening movement occurs, that is said rods 226, 226' and 228, 228' are widened out or moved away from rods 216, 216' for a sufficient distance for release of the hank, and the structure undergoes a backward return movement along the guides 282, unthreading the rods from the hanks. Also in this case, a suitable wall on the carriage or on the carriage lifting apparatus would cooperate in holding the hanks on the carriage. Then, the head 201 is upset or tilted through 90° (arrow R'), which is upward moved along with the rods for a transfer going movement along the guides 282 towards the carriage, without the rods interferring with the carriage (obviously, these movements may vary in accordance with the available space in the area in which the machine is installed). Then a second upsetting or tilting (arrow R'') occurs through 90° (so as to complete the return upsetting or tilting through 180°) by rotation through 90° of implement or device 201 to arrange the rods in vertical attitude and the upward movement of the pliers to arrange the rods as moved near one another. The cycle can then be started again.

For the cycle just described, it should be appreciated that the approaching and downward movements for the pliers are not strictly required, but such pliers could remain at a fixed vertical distance from one another, as the pliers would thread between the hanks entering at the front from the end thereof facing the machine.

Referring to FIGS. 10, 11, 12 and 13, a third embodiment of the invention will now be described. In such figures, some elements correspond to those of the first embodiment and have beed designated by corresponding reference numerals, augmented by 200; for a more detailed description thereof reference should be made to the description of the first embodiment.

Figure 10:
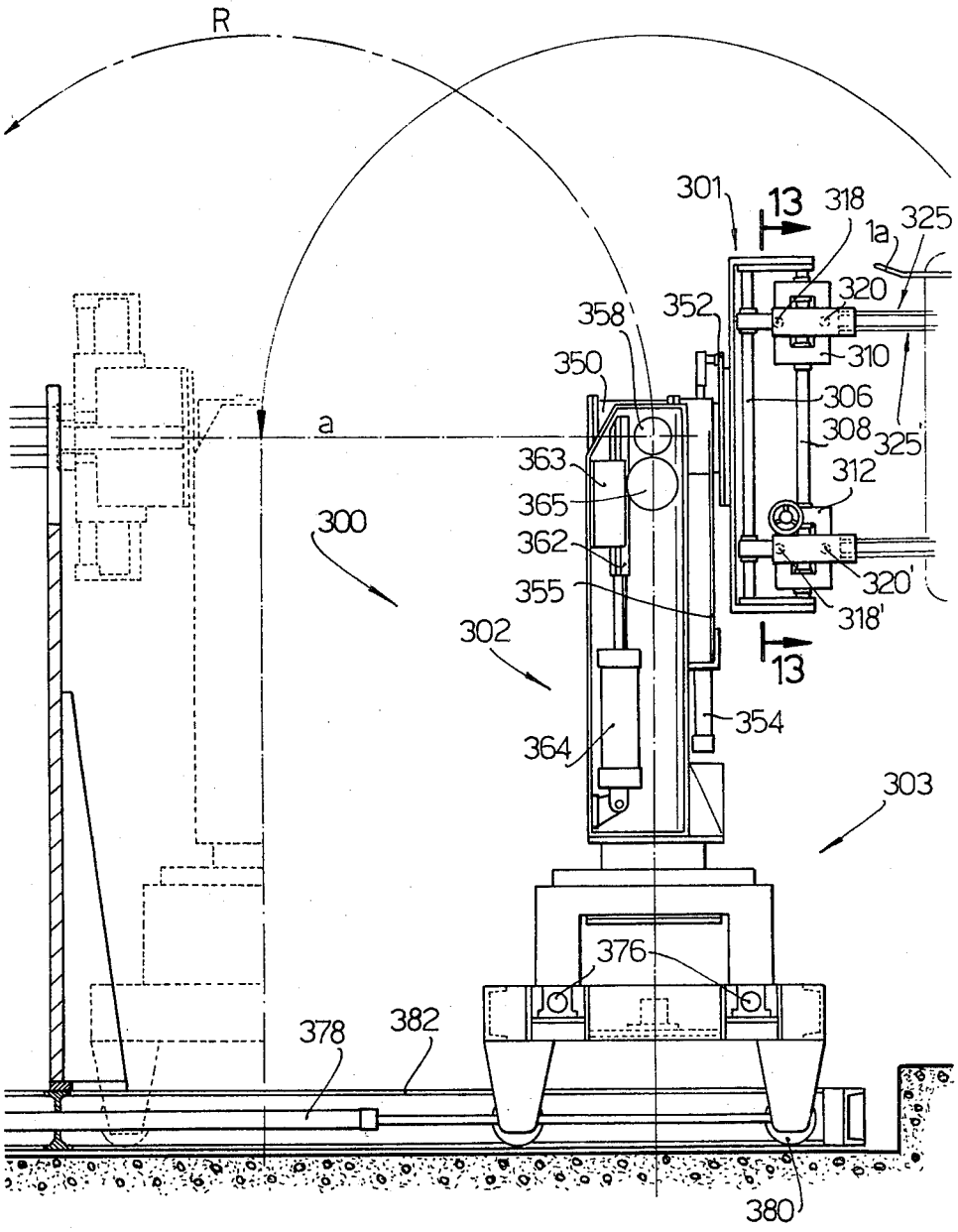
FIG. 10 is a side view showing a third embodiment of the machine and relative operating positions.

The machine 300 cooperates with a hank movement line, of which a hank carrying support 1*a* is shown in FIG. 10; the hank carrying support 1*a* is of the type cantilever supported with respect to the chain in order to prevent the rods of the machine pliers from interferring with the chain.

Said machine 300 comprises a rod holder head 301, a framework 302 and a movable base 303.

The rod holder head 301 comprises a rigid frame 304 carrying slide guides or vertical columns 306 and 308. Two sliding shoes, namely an upper shoe 310 and a lower shoe 312 are mounted on said two columns 306 and 308. Each of the shoes carry two bars 318, 320 and 318', 320' respectively having rod carrying slides 322, 324 (identical to those of the first embodiment) sliding thereon, so as to carry as a whole the upper pliers 325, that is the upper rods 326 (movable), 316 (fixed) and 328 (movable), and the lower pliers 325', that is the lower rods 326' (movable), 316' (fixed) and 328' (movable).

Unlike the first embodiment (FIG. 13), the upper shoe 310 is fixed in place on the columns 306 and 308, whereas the lower shoe 312 is manually adjustable in position by a handwheel 386 on a rack 384 of column 308, depending on the dimensions of the hanks to be transferred.

As to the members provided for rotation of the head about a horizontal axis, for tilting or upsetting of the head, and for translational movements, said machine 300 is identical to machine 200 or machine 100, with the exception of the apparatus or device for rotation about the vertical axis.

The operation of said machine 300 will now be described. The vertical distance or spacing between the set of upper rods 326, 316, 328 and the set of lower rods 326', 316', 328' is manually adjusted by means of said handwheel 386 in accordance with the length of the hanks to be treated.

In FIG. 10, the machine 300 is shown with the rods threaded between adjacent hanks. In such a position, the machine is effecting a hook tracking movement to follow the advancement or feeding movement of the hank carrying hook 1 in the direction of arrow A in FIG. 12. Then the pliers are closed, that is the rods 326, 326', 328, 328' move near the rods 316, 316', respectively. Then, the machine effects a drawing transfer under the control of the cylinder-piston unit 378 to the left in FIG. 10 until the hanks are unthreaded from the hank carrying supports. Once the hank unthreading is completed, the tracking movement may stop, while the return movement in opposite direction thereto is started on guides 376. Then, the rod holder head 301 rotates through 90° about the axis "a" of the above mentioned gudgeon pin 348, as in the preceding embodiments, for horizontal arrangement of the hanks retained between the rods, then simultaneously or successively followed by an upsetting or tilting through 180° about the axis "b" of supports 357 for doffing or unloading the hanks on the carriage 20. Then the pliers are opened through the action of springs 334, and similarly to the preceding embodiments, the machine effects an unloading transfer or translation to the right in FIG. 10, until the rods are unthreaded, leaving the hank at laid down position on the carriage. Now, the pliers holder head is rotated through 90° about the a"axis" of the gudgeon pin 348, and a further upsetting or tilting through 180° occurs for restoring the attitude shown by full line in FIG. 10.

It should be noted that a pliers holder head of fixed vertical spacing or distance between the rods, that is where the distance or spacing is adjusted at the beginning of a batch of hanks to be treated, but does not vary during the working cycle, could be also used on the above described machine 200.

Finally, a fourth embodiment of the machine, designated by reference numeral 400 and shown in FIGS. 14 to 18, will now be described. Therein, some elements similar to those for the machine of the first embodiment carry like reference numerals, but augmented by 300, and will not be further described.

The machine 400 is intended for cooperation with a carriage 50, which is not carried on a lifting device, that is to say is at a fixed level, generally with its wheels resting on the ground throughout the operation cycle; and this machine 400 cooperates with hank carrying supports or hooks 1*b* of a type at present widely used.

The machine 400 has a pliers holder head 401, which in the embodiment shown is identical to that previously described for the first and second embodiments; that is, the pliers holder head has an upper pliers 425 with rods 426, 416, 428 and a lower pliers 425' with rods 426', 416', 428', of which the center rods 416, 416' are fixed, while the end or side rods can move near the center rods. Moreover, the upper and lower rods can move downward by predetermined different distances under the control of a mechanism, such as that shown in FIG. 4. The machine 400 could also carry a head of fixed vertical distance between the pliers, such as the above described head 301. The head 401 is rotatable through 90° about a horizontal axis "a", just as for the previously described heads. In this case, the rotational movement is preferably supplied from a motor 454 through a gear system or the like, not shown in details as accessible to those skilled in the art. A motor 464 and a gear unit 465 (not shown in details) provide for the upsetting or tilting R of the head through 180° about a horizontal axis shown at "b" in the figures of the drawings. The head 401 and its rotation control unit and upsetting control unit are carried on a movable framework 402. The framework 402 is provided with four wheels or rollers 486 sliding in vertical rails 487, 487'. The latter are integral with a frame 472 transversely sliding along guides 476 under the operation of a geared motor 475 through a worm screw 475'. The guides 476 are carried on a lower frame member 474 movable by wheels or rollers 480 in guides 482. The movement along said guides 482 is given by a motor 478 (on a bracket 479 integral with said frame member 474). The output shaft of motor 478 carries a pinion 488 driving (for example through a chain) a gear wheel 489 integral with a spindle 490. The latter carries at the ends thereof gear wheels 492 for meshing with fixed racks 494 on said guides 482.

A mechanism for lifting and lowering of framework 402 and associated elements will now be described, however such a mechanism not being intended as limiting, but only for illustrating purpose.

A motor 496 is carried on said frame member 472 and controls or drives a shaft 497. At spaced apart positions, two drums 498 and 498' are keyed on said shaft 497, at one end of which belts or chains 499, 499' are anchored, such belts or chains passing on idle pulleys 501 and 501', respectively, integral with the vertical rails 487, 487'. The ends of said belts or chains 499, 499' opposite to the drums are integral with the framework 402. Thus, the operation of said motor 496 controls the lifting and lowering of framework 402.

The operation of machine 400 will now be described.

Figure 14:
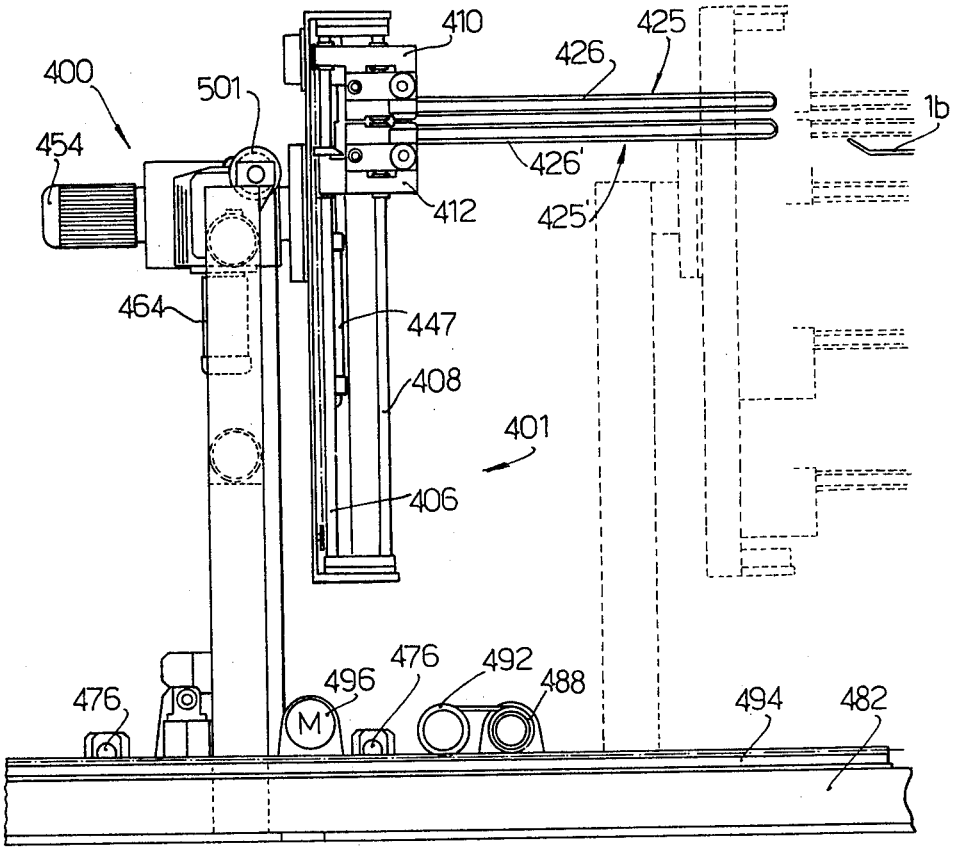
FIG. 14 is a side view showing a fourth type or embodiment of machine according to the invention.
Figure 15:
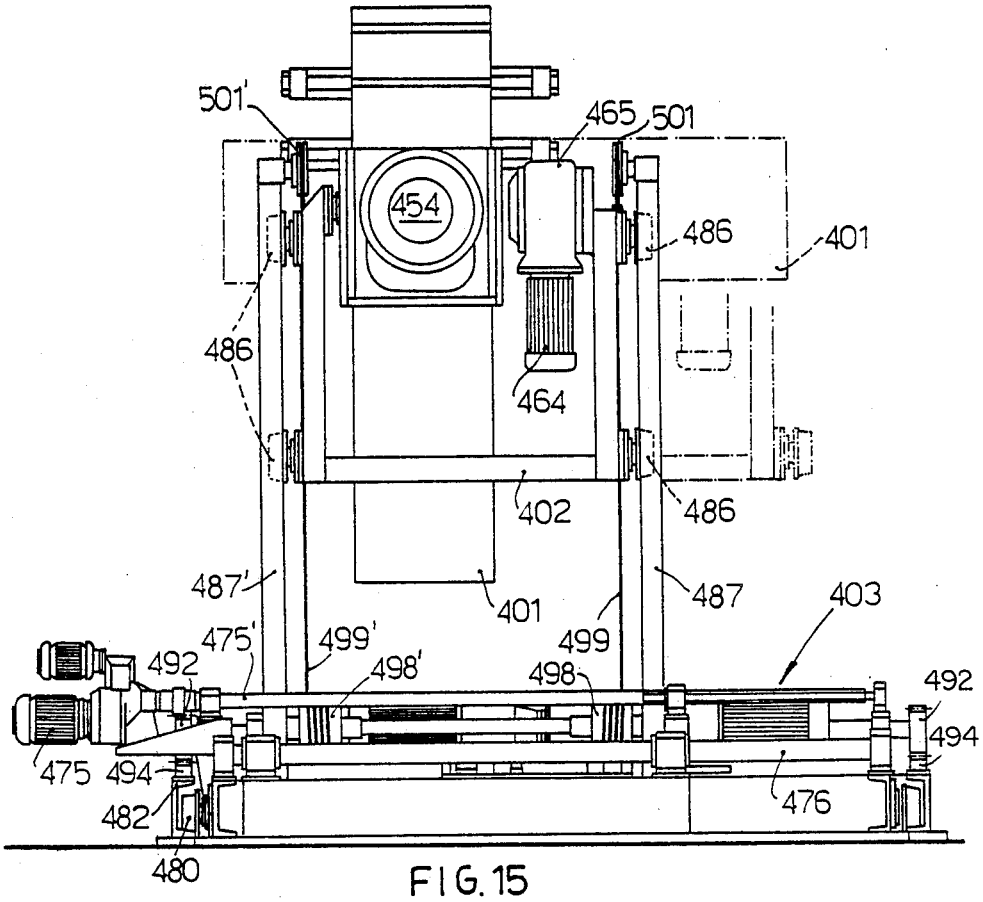
FIG. 15 is a view as seen from the left in FIG. 14.
Figure 16:
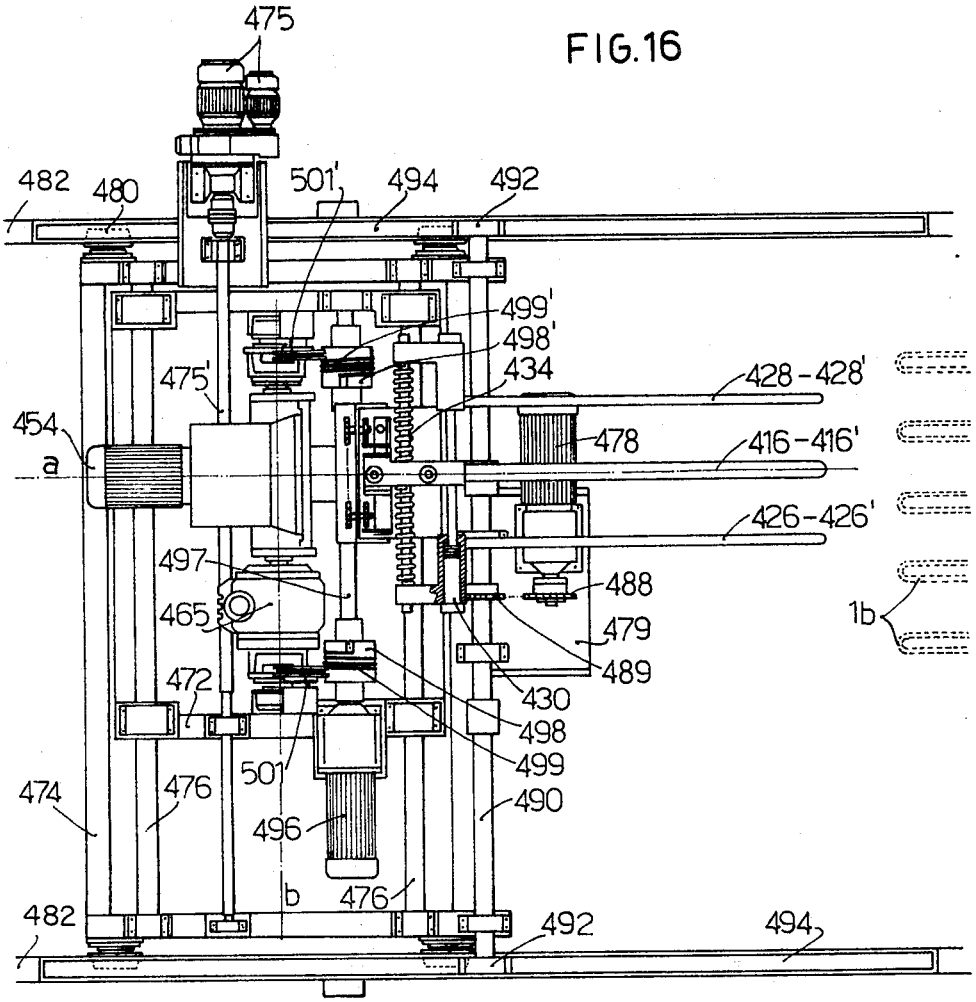
FIG. 16 is a top view of FIG. 14.
Figure 17:
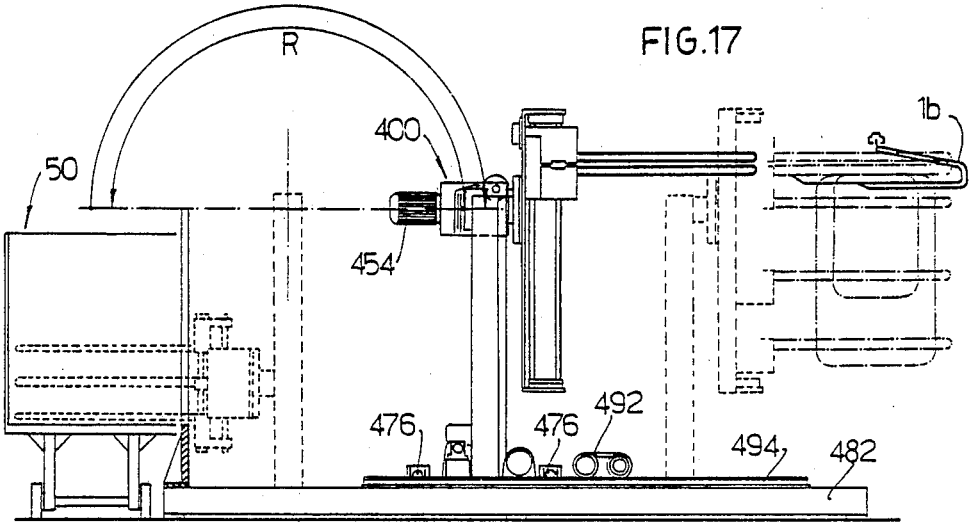
FIGS. 17 and 18 are side and top views respectively, on a different scale from that of FIGS. 14 to 16, showing various operating positions of the machine.
Figure 18:
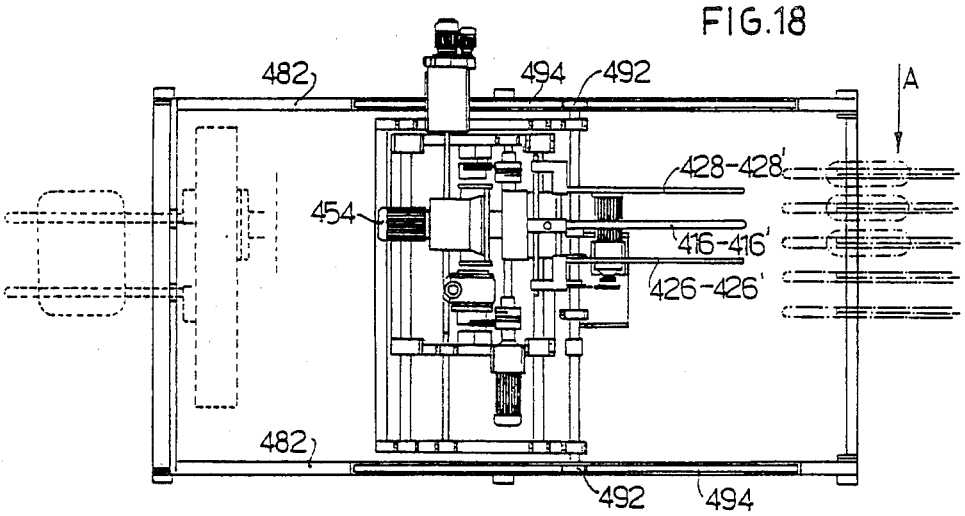

From the position shown by full line in FIGS. 14 and 17, the machine effects a drawing inlet transfer or translation to the right, as seen in the drawing, along the guides 482 under the control of said motor 478 to the position shown by dashed line. At the same time, the machine effects a hook tracking movement along said guides 476. Then, the pliers (in case of vertical lowering pliers) downward move along the hanks under the control of motor 454. Then, the pliers closing movement occurs under the control of cylinder-piston units 430 and 432, similarly as for the preceding embodiments. Then, said motor 478 controls a drawing outlet transfer or translation to the left, as seen in FIGS. 14 and 17, to unthread the hanks from the respective hank carrying supports. After unthreading, the hook tracking movement is stopped and the return movement for the structure to the unloading or doffing position is started. Now, successively or simultaneously, the following operations occur: rotation through 90° of head 401 (under the control of motor 454) about said axis "a" to arrange the hanks at horizontal attitude; upsetting or tilting through 180° of head 401 (under the control of motor 464) about said axis "b", and, if required, the doffing inlet transfer or translation to arrange the hanks exactly on the vertical of carriage 50.

The motor 496 then controls the lowering of the framework 402 to the level of the hanks on the carriage 50. The pliers open due to the action of springs 434 and a doffing outlet transfer or translation is carried out along the guides 482 to the right, as seen in the figures of the drawings.

Then, the motor 496 causes the framework 402 to move upwards to the height or level for drawing new hanks. Finally, a rotation through 90° in a direction opposite to the preceding directions (clockwise in FIG. 15) and an upsetting or tilting through 180° opposite to the preceding one (clockwise in FIG. 17) set again the machine at the station condition (shown by full line in FIG. 17).

Obviously, the machine of this embodiment, as well as that of the other embodiments, will be provided with all of the drives and controls which may be useful for the timing and complete or partial automation of the operations, such arrangement of the controls being in the range of any skilled in the art and accordingly not further described herein.

It should be noted that this application is intended to cover also all of the combinations and variants of parts in the described machines, which may be of some interest and are accessible to those skilled in the art. For example, the possibility was above mentioned of using heads with vertically fixed spaced apart pliers, instead of movable pliers. Also the arrangement of the drawing rods in the upper and lower units may be varied, by using instead of a fixed center rod and movable side rods for simultaneously gripping two hanks, only two movable rods, or one movable rod and one fixed rod, or finally any number of rods however arranged for the gripping of the desired number of hanks.

What I claim is:

1. A machine for removing yarn hanks from hank carriers and for unloading the removed hanks onto container means, said machine comprising:

plier means for removing yarn hanks from hank carriers, said plier means including a fixed center rod and two side rods, the side rods being movable towards the center rod at the two opposite sides thereof for simultaneous gripping of two hanks and being movable away from said center rod for releasing gripped hanks; and pliers operating means for controlling said gripping and said releasing movements.

2. A machine according to claim 1, wherein said center rod and side rods are substantially parallel to each other.

3. A machine according to claim 1, further comprising a plier holder head having first and second plier means, said first and second plier means in an operative condition being arranged at a distance from each other along hank sides.

4. A machine according to claim 3, wherein the distance between said first plier means and said second plier means is adjustable.

5. A machine according to claim 3, further comprising rotating means for rotating said plier holder head about a first substantially horizontal axis which is substantially parallel to extension of said fixed center rod from the machine.

6. A machine according to claim 5, wherein said rotating means comprises a gudgeon pin integral with said head and rotatably carried within a sleeve, a protrusion integral and coaxial with said head and said pin, and means for imparting a rotation to said protrusion.

7. A machine according to claim 5, further comprising overturning means for overturning said head about a second substantially horizontal axis, transverse to said first horizontal axis.

8. A machine according to claim 7, wherein said rotating means comprises a gudgeon pin integral with said head and a sleeve, wherein said overturning means comprises spindle-like extensions for said sleeve which are rotatable within aligned supports having an axis coincident with said second horizontal axis; and wheel and rack control means for overturning said sleeve.

9. A machine according to claim 8, further comprising a framework carrying said supports, a machine base carrying said framework, and means for moving the framework in a direction parallel to the extension of the hank carriers.

10. A machine according to claim 9, for use with hank carriers moving along an advancement line, comprising tracking means for moving said base in a tracking movement parallel to the advancement line of the hank carriers.

11. A machine according to claim 9, further comprising means interposed between said framework and said base for providing a mutual rotation about a vertical axis.

12. A machine according to claim 9, wherein said framework is integral with said base.

13. A machine according to claim 9, further comprising lifting means for said framework, said lifting means moving said framework in lifting and lowering directions with respect to said base.

14. A machine according to claim 9, further comprising lifting means for moving said framework, said lifting means including vertical rails integral with said base, framework side wheels for sliding in said rails, belt means fixed to said framework, and a pulley and winding drum system for moving said belt means to thereby move said framework.

15. A machine according to claim 3, wherein said head comprises guides having sliding shoes carried thereon, one of which carries said first plier means and pliers operating means therefor, and another of said sliding shoes carrying said second plier means and pliers operating means therefor.

16. A machine according to claim 3, wherein said first plier means is fixed in place and said second plier means is adjustable in position, said machine further comprising a pinion and rack device for adjusting the position of said second plier means.

17. A machine according to claim 3, wherein said first plier means and said second plier means are both movable between a first idle condition, at which they are close to each other, and said operative condition, at which they are arranged at a distance from each other, the movement between said two conditions being exerted on one of said plier means and being transmitted to the other of said plier means.

18. A machine according to claim 1, wherein said pliers operating means comprises fluid controlled operating means for controlling said gripping movement and spring operating means for effecting said releasing movement.

19. A machine for drawing yarn hanks from hank carriers and for unloading the hanks onto a container means, the yarn hanks hanging on said hank carriers so that yarn threads are in a vertical arrangement on each side of the carrier, said hanks having an exposed lateral surface on two opposed sides thereof, said machine comprising:

a plier holder head;

plier means positioned on said head for clamping hanks, said plier means having elements operable between an open condition, in which they are spaced from a hank interposed between them, and a closed condition, in which they clamp a hank interposed between them;

means for operating said plier means between said open and said closed condition, said plier means when in said closed condition clamping said hank at least along two clamping lines which are substantially transverse to said threads and spaced from each other along the hank sides; and means for rotating said head about a substantially horizontal axis to bring a clamped hank to a substantially horizontal attitude.

20. A machine according to claim 19, wherein said plier means comprises two pairs of rod shaped plier elements, said pairs in a closed clamping condition being arranged at a distance from each other along said exposed lateral surfaces of the hank, each said pair of elements forming a pair of pliers, said plier means being carried on said plier holder head.

21. A machine according to claim 20, wherein said plier rods are substantially parallel to each other.

22. A machine according to claim 19, further comprising at least two plier means, the spacing between which is adjustable.

23. A machine according to claim 19, wherein said plier means comprises first pliers and second pliers, said first pliers being fixed in position and said second pliers being adjustable in position, said machine including a rack and wheel device for adjusting the position of said second pliers.

24. A machine according to claim 19, wherein said operating means comprises fluid operating means for closing the plier means and spring operating means for opening the plier means.

25. A machine according to claim 19, wherein said rotating means rotates said plier holder head about a first substantially horizontal axis which is substantially parallel to an extension of said plier means from the machine, said rotating means comprising a gudgeon pin integral with said head, a sleeve rotatably carrying said pin, a protrusion integral and coaxial with said head and said pin, and means for imparting rotation to said protrusion.

26. A machine according to claim 19, wherein said rotating means comprises a gudgeon pin integral with said head and a sleeve, said machine further comprising overturning means for overturning said head, said overturning means comprising spindle-like extensions for said sleeve, which are rotatable within aligned supports having their axes coincident with a second horizontal axis extending transverse to said substantially horizontal axis, and rack and pinion control means for overturning said sleeve.

27. A machine according to claim 26, further comprising a framework carrying said supports, a machine base carrying the framework, and means for moving said base in a direction parallel to an extension of the hank carriers.

28. A machine according to claim 27, for use with hank carriers moving along an advancement line, comprising tracking means for moving said base in a tracking movement parallel to the hank carrier advancement line.

29. A machine according to claim 27, further comprising means interposed between said framework and said base for providing for a mutual rotation about a vertical axis.

30. A machine according to claim 27, further comprising lifting means for lifting and lowering said framework on said base; said lifting means comprising vertical rails integral with the base, framework side wheels slidable in said rails, belt means fixed to the framework, and a pulley and winding drum system for moving said belt means to thereby move said framework.

31. A machine according to claim 19, for use with hank carriers moving along an advancement line, said machine further comprising means for moving said plier holder head in a tracking movement parallel to the advancement line.

* * * * *